US010435986B2

(12) United States Patent
Holder

(10) Patent No.: US 10,435,986 B2
(45) Date of Patent: Oct. 8, 2019

(54) METHOD AND APPARATUS FOR SECONDARY RECOVERY OPERATIONS IN HYDROCARBON FORMATIONS

(71) Applicant: Superior Energy Services, LLC, Harvey, LA (US)

(72) Inventor: Barry K. Holder, Montgomery, TX (US)

(73) Assignee: Superior Energy Services, LLC, Harvey, LA (US)

( * ) Notice: Subject to any disclaimer, the term of this patent is extended or adjusted under 35 U.S.C. 154(b) by 484 days.

(21) Appl. No.: 14/932,594

(22) Filed: Nov. 4, 2015

(65) Prior Publication Data

US 2016/0130912 A1 May 12, 2016

Related U.S. Application Data

(60) Provisional application No. 62/075,956, filed on Nov. 6, 2014.

(51) Int. Cl.

| | |
|---|---|
| ***E21B 43/14*** | (2006.01) |
| ***E21B 34/14*** | (2006.01) |
| *E21B 34/00* | (2006.01) |

(52) U.S. Cl.
CPC ..... *E21B 34/14* (2013.01); *E21B 43/14* (2013.01); *E21B 2034/007* (2013.01)

(58) Field of Classification Search
CPC .... E21B 43/119; E21B 34/14; E21B 43/1185; E21B 43/11852; E21B 43/11885; E21B 43/263
See application file for complete search history.

(56) References Cited

U.S. PATENT DOCUMENTS

| | | | | |
|---|---|---|---|---|
| 2,335,409 | A * | 11/1943 | Hare | E21B 47/1015 166/254.2 |
| 4,064,935 | A * | 12/1977 | Mohaupt | E21B 43/263 102/313 |
| 4,633,954 | A | 1/1987 | Dixon et al. | |
| 4,721,158 | A | 1/1988 | Merritt, Jr. et al. | |
| 4,798,244 | A | 1/1989 | Trost | |
| 5,273,112 | A | 12/1993 | Schultz | |
| 5,823,266 | A | 10/1998 | Burleson et al. | |
| 6,853,921 | B2 | 2/2005 | Thomas et al. | |
| 7,073,589 | B2 | 7/2006 | Tiernan et al. | |
| 7,165,614 | B1 | 1/2007 | Bond | |
| 7,243,725 | B2 | 7/2007 | George et al. | |
| 8,127,832 | B1 | 3/2012 | Bond | |
| 8,365,824 | B2 * | 2/2013 | Phillips | E21B 43/11852 166/297 |
| 8,381,807 | B2 | 2/2013 | Jackson et al. | |

(Continued)

FOREIGN PATENT DOCUMENTS

WO 2015/009753 A1 1/2015

*Primary Examiner* — David J Bagnell
*Assistant Examiner* — Lamia Quaim
(74) *Attorney, Agent, or Firm* — Jones Walker LLP

(57) ABSTRACT

A production casing string including a plurality of propellant sleeves positioned on an exterior of the production casing string, and each propellant sleeve includes a firing mechanism and a firing sleeve for selectively covering and uncovering the firing mechanism. The casing string also includes an identifiable marker associated with each propellant sleeve and at least one selective bi-directional valve assembly associated with each propellant sleeve.

19 Claims, 5 Drawing Sheets

(56) References Cited

U.S. PATENT DOCUMENTS

| | | | | |
|---|---|---|---|---|
| 9,689,247 | B2 | 6/2017 | Holder et al. | |
| 2003/0000703 | A1 | 1/2003 | Cernocky et al. | |
| 2004/0134658 | A1* | 7/2004 | Bell | E21B 43/116 166/297 |
| 2005/0263286 | A1* | 12/2005 | Sheffield | E21B 43/117 166/297 |
| 2006/0048664 | A1 | 3/2006 | Tiernan et al. | |
| 2010/0230104 | A1 | 9/2010 | Nolke et al. | |
| 2011/0056578 | A1* | 3/2011 | Mathiesen | F16K 15/02 138/46 |
| 2011/0139433 | A1 | 6/2011 | Jackson et al. | |
| 2013/0168077 | A1 | 7/2013 | Jackson et al. | |
| 2014/0076542 | A1* | 3/2014 | Whitsitt | E21B 34/14 166/250.1 |
| 2014/0202707 | A1* | 7/2014 | Howell | E21B 34/14 166/374 |
| 2015/0204171 | A1* | 7/2015 | Hocking | E21B 43/164 166/303 |
| 2015/0226031 | A1* | 8/2015 | Hekelaar | E21B 34/10 166/298 |
| 2015/0361761 | A1* | 12/2015 | Lafferty | E21B 23/14 166/250.01 |
| 2016/0032713 | A1* | 2/2016 | Hallundb K | E21B 33/127 166/255.1 |

* cited by examiner

METHOD AND APPARATUS FOR SECONDARY RECOVERY OPERATIONS IN HYDROCARBON FORMATIONS

I. CROSS-REFERENCE TO RELATED APPLICATION

This application claims the benefit under 35 USC 119(e) of U.S. Provisional Application No. 62/075,956 filed Nov. 6, 2014, which is incorporated by reference herein in its entirety.

II. BACKGROUND OF INVENTION

The present invention relates to secondary recovery techniques used to increase production from oil and gas wells. It is well recognized by persons skilled in the art of oil recovery techniques that only a fraction of the amount of oil or petroleum originally present in a petroleum reservoir can be recovered by primary production, e.g., by allowing the oil to flow to the surface of the earth as a consequence of naturally occurring energy forces. When the naturally occurring energy forces are no longer sufficient, the industry often engages in so called "secondary recovery" techniques. Conventionally, these techniques often involve injecting water into a formation by one or more vertical injection wells to displace petroleum toward one or more spaced-apart vertical production wells, from which the petroleum is recovered to the surface. However, given the modern trend toward drilling fewer vertical wells and extending numerous lateral wells from the vertical wells that are drilled, the prior art vertical injection wells often perform poorly in re-pressurizing under-pressured hydrocarbon formations. New techniques for optimizing the formation pressure in lateral wellbores would be a significant improvement in the art due to the heterogeneous nature of most producing formations.

III. SUMMARY OF SELECTED EMBODIMENTS OF INVENTION

One embodiment of the present invention is a method of managing a hydrocarbon producing formation having a primary wellbore which includes at least one deviated branch wellbore. The method includes the step of: (a) positioning a production casing string in the deviated branch wellbore, the production casing string including: (i) a plurality of propellant sleeves positioned on the exterior of the production string; (ii) an identifiable marker associated with each propellant sleeve; and (iii) at least one discharge-only valve and at least one intake-only valve associated with each propellant sleeve. The method further includes the steps of (b) cementing the production casing string within the deviated branch wellbore; (c) positioning a tool within the production casing string where the tool locates on the identifiable marker associated with one of the propellant sleeves; (d) selectively igniting propellant in the propellant sleeve of step (c); and (e) opening at least one of the discharge-only valve or intake-only valve associated with the propellant sleeve in step (c).

Another embodiment is a production casing string including a plurality of propellant sleeves positioned on an exterior of the production casing string, and each propellant sleeve includes a firing mechanism and a firing sleeve for selectively covering and uncovering the firing mechanism. The casing string also includes an identifiable marker associated with each propellant sleeve and at least one selective bi-directional valve assembly associated with each propellant sleeve.

IV. BRIEF DESCRIPTION OF THE DRAWINGS

V. DETAILED DESCRIPTION

Figure 1A:
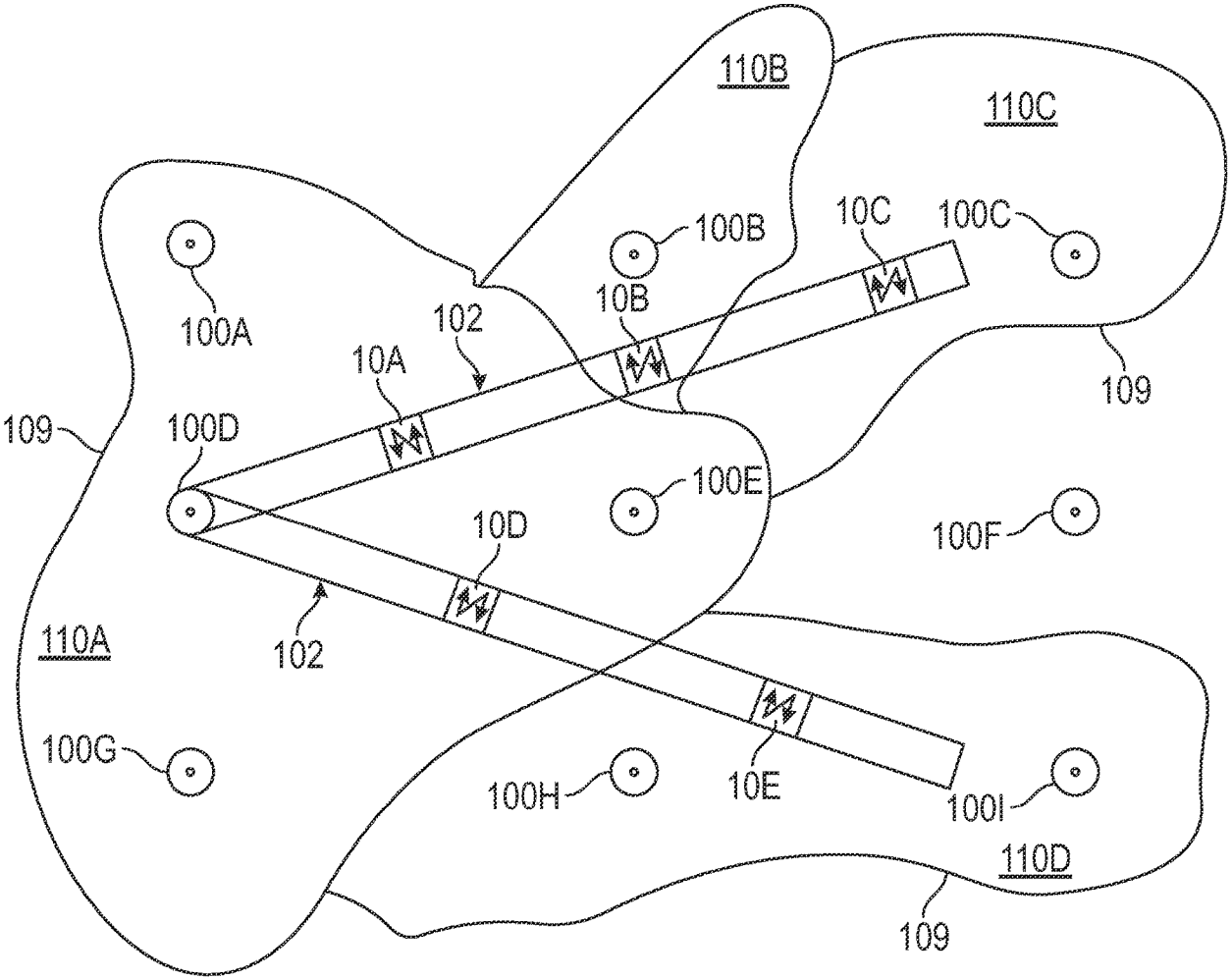
FIG. 1A illustrates schematically an aerial view of a field of wellbores.

FIG. 1A schematically illustrates an aerial view of a field of wellbores 100. In a conventional water flooding operation, fluids (e.g., water) are pumped down selected wellbores at a positive pressure (i.e., above hydrostatic) to displace petroleum toward another wellbore. For example, in FIG. 1A, water could be pumped down wellbore 100D in order to attempt displacing petroleum toward wellbores 100A, 100E, and 100G. One common difficulty in water flooding operations is that the producing formation is not uniformly porous. For example, as suggested in FIG. 1A, impermeable geologic formations 109 may, hydraulically speaking, divide the petroleum producing formation into multiple compartments 110A to 110D. Thus, pumping water into wellbore 100E will have little or no effect in displacing petroleum toward wellbores 100B, 100C, 100H, etc. Wellbores 100 are generally considered "vertical" wellbores, which simply means the wellbores are substantially vertical (e.g., have a greater vertical component than horizontal component). FIG. 1A further shows two deviated branch (e.g., "horizontal") wellbores 102 which traverse through the formation and the compartments 110. Obviously, deviated branch wellbores do not need to be perfectly horizontal and may include any branch wellbore deviating off of a "vertical" wellbore, but generally "horizontal" wellbores will follow the lateral direction of the formation of interest.

Figure 1B:
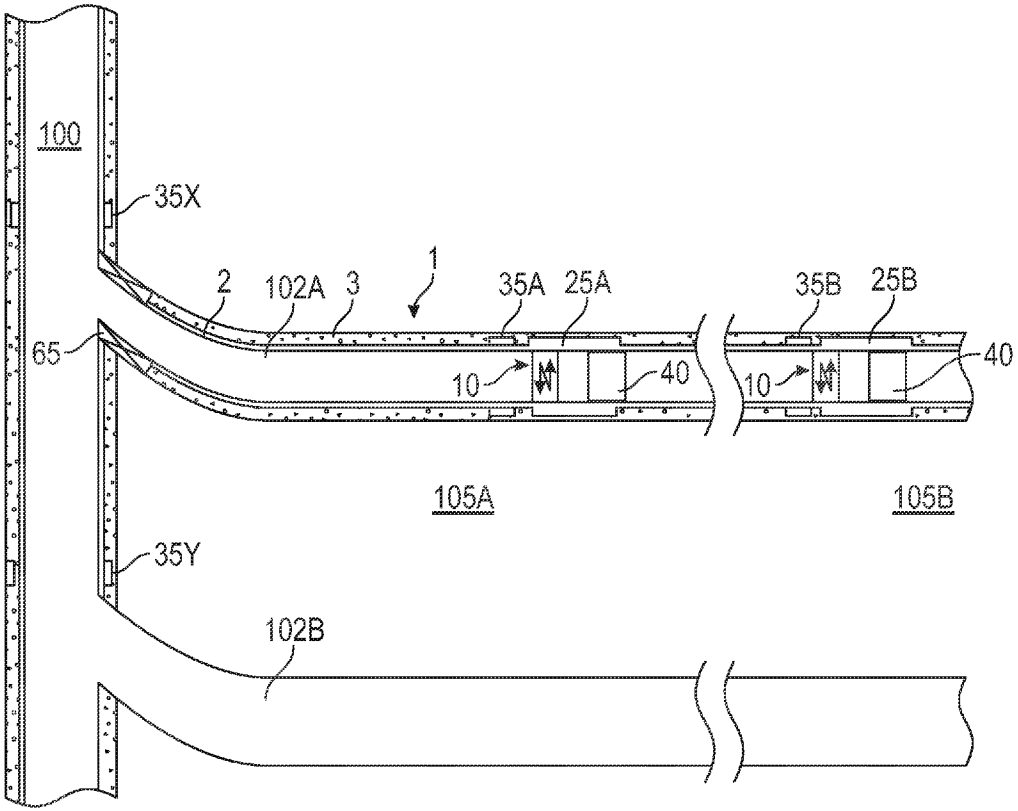
FIG. 1B illustrates a primary wellbore with two deviated branch (horizontal lateral) wellbores.

FIG. 1B illustrates in more detail one embodiment of deviated branch wellbores 102 and the components deployed therein. A primary wellbore 100 is formed in a generally vertical direction to access one or more oil/gas containing geological formations. FIG. 1B shows the primary wellbore 100 as having been cased and cemented. Deviated branch wellbores 102 are formed into the oil/gas containing formations following the direction of the formations (generally in a "horizontal" direction) in order to maximize the drainage area through the formation. FIG. 1A illustrates two deviated branch wellbores at approximately the same depth (e.g., both in the same formation). However, it will also be understood that since there are typically multiple oil producing formations separated by natural barriers at different depths, a deviated branch wellbore 102 may be formed though each of these formations as suggested by the branch wellbores 102A and 102B in FIG. 1B. Therefore, it is necessary to keep in mind the distinction between multiple deviated branch wellbores at approximately the same depth (i.e., in the same formation as suggested in FIG. 1A) and multiple deviated branch wellbores at different depths (i.e., in different formations as suggested in FIG. 1B). Generally, unless stated otherwise, this disclosure's reference to multiple branch wellbores is addressing the situation of multiple branches within the same formation. However, this disclosure also contemplates the employment of different branches in different formations (e.g., formations at different depths).

Additionally, the individual formations are not uniform in their permeability and other relevant characteristics and are typically divided into "zones" 105 along the length of the branch wellbore. It is often desirable to treat the different zones or groups of zones within the same branch wellbore independently or to treat one zone in a manner that enhances production in another zone. It will of course be understood that while FIG. 1B shows two zones for simplification, there could typically be many additional zones within branch wellbore 102A.

As used in this disclosure, "up" or "uphole" means the direction along the wellbore toward the surface and "down" or "downhole" means in the direction toward the toe of the wellbore. Because the wellbore may often be deviated or horizontal, "up" or "down" should not be assumed to be in the vertical direction or to even have a vertical component. Likewise, describing a first tool component as "above" ("uphole of") or "below" ("downhole of") a second tool component means the first tool component is closer to or further from the surface, respectively, along the wellbore path (when the tool assembly is positioned in the wellbore) than the second tool component. The terms "casing" or "production casing" are used generically herein to mean any type of casing, pipe, tubing, or other tubular member typically used downhole in oil and gas operations. "Casing" may include discrete pipe members threaded together or a continuous tubular member fed downhole (e.g., production tubing).

In the FIG. 1B illustration, branch wellbore 102A is shown with a production casing string 2 "cemented" in the wellbore by the layer of cement 3 pumped into the annulus between the wellbore surface and the outer wall of casing 2. Typically, casing 2 in branch wellbore 102 has a smaller diameter than the casing in primary wellbore 100. A packer 65 (e.g., a sealbore packer with an upper polished internal sealbore) is positioned at the junction of branch wellbore 102A and the primary wellbore 100 inside the lateral bend. One more specific packer example would be a model CSHP-II Non-Rotational Packer, available from Superior Energy Services, Completion Services Division, of Houston, Tex. Positioned on the casing string 2 in each zone 105 (and shown schematically in FIG. 1B) is an identifiable marker 35, a propellant sleeve 25, a firing sleeve 40, and a selective bi-directional valve assembly 10.

Figure 2:
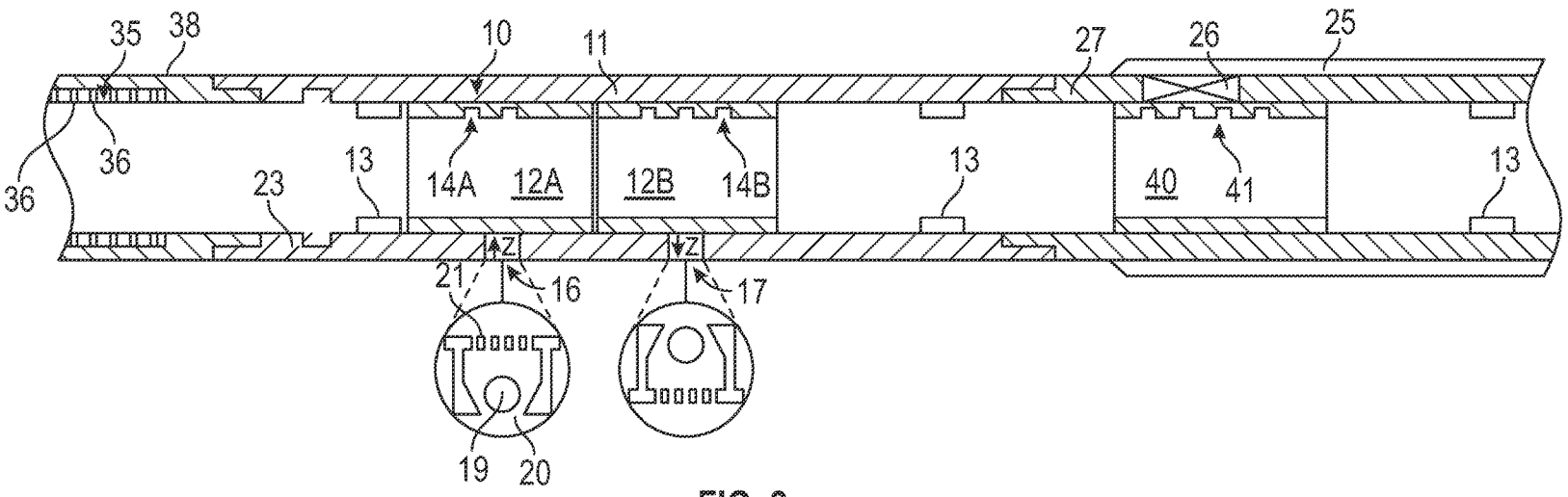
FIG. 2 illustrates one embodiment of the selective bi-directional valve assembly incorporated in a sub, separate from a propellant assembly.

One embodiment of selective bi-directional valve assembly 10 is seen in more detail in FIG. 2. The valve assembly 10 is formed in a section of casing or a "casing sub" 11 by the combination of an in-take only valve 16 and a discharge-only valve 17 positioned in the wall of casing sub 11, with each allowing uni-directional flow between the interior and exterior of casing sub 11. For example, the detail of FIG. 2 suggests how one embodiment of intake-only valve 16 may be a ball-type check valve with constricting end 20 and pass-flow end 21. It can be seen how valve 16 is "intake-only" since fluid flowing in the external-to-internal direction will push ball 19 against the pass-flow end 21 allowing fluid into the casing. On the other hand, the internal-to-external flow direction will push ball 19 against constricted end 20 and block the flow of fluid. Similarly, discharge-only valve 17 has the pass-flow end 21 and constricted end 20 reversed, thus allowing fluid flow in the internal-to-external direction, but blocking fluid flow in the opposite direction. Naturally, this embodiment of valves 16 and 17 is simply one example of a unidirectional (or "check") valve and many other conventional or future developed unidirectional valves could be used in the alternative.

FIG. 2 also shows that each of in-take only valve 16 and discharge-only valve 17 have a separate valve sleeve 12A and 12B, respectively, which cover the valves. The valve sleeves 12A and 12B may have conventional seal rings positioned between their external diameter and the inner diameter of casing sub 11. The valve sleeves 12 may also each have unique profiles 14 which allow an opening tool (explained below) to selectively engage and slide the valve sleeves to a different position to support a desired flow configuration. Although not explicitly shown in FIG. 2, it will be understood that in other embodiments, the valve sleeves 12 could have the same profiles 14 and the opening tool would use a position determination to select the sleeve to engage. Also formed on the inner diameter of casing sub 11 are a series of sleeve stops 13 which arrest further sliding of the sleeves once they engage the sleeve stops 13.

FIG. 2 further shows propellant sleeve 25 formed on a separate casing sub 27 (also referred to as "propellant sub" 27) which is threaded onto casing sub 11. In preferred embodiments, propellant sleeve 25 is a concentric sleeve formed on the external surface of the casing sub that defines a compartment containing a propellant and other well stimulation materials. Alternative propellant sleeve structures, propellant types, and well stimulation materials are discussed in U.S. Application Ser. No. 61/970,775 filed Mar. 26, 2014, entitled, "Location and Stimulation Methods and Apparatuses Utilizing Downhole Tools," which is incorporated by reference herein in its entirety. In one embodiment, the propellant positioned in the propellant sleeves has a burn rate of between about 300 ft/sec and about 10,000 ft/sec. Typically the propellant sleeve will have some form of firing mechanism 45 (not shown in FIG. 2, but seen in FIG. 3). The firing mechanism may be any number of conventional or future developed mechanisms for activating (or "igniting") the propellant. In one example, the firing mechanism 45 could be pressure based, i.e., the pressure within the casing exceeding a certain level would trigger the firing mechanism. In another example, the firing mechanism could be electronically triggered, e.g., by electrical power and electrical signals provided by the opening tool (described in more detail below).

Figure 3:
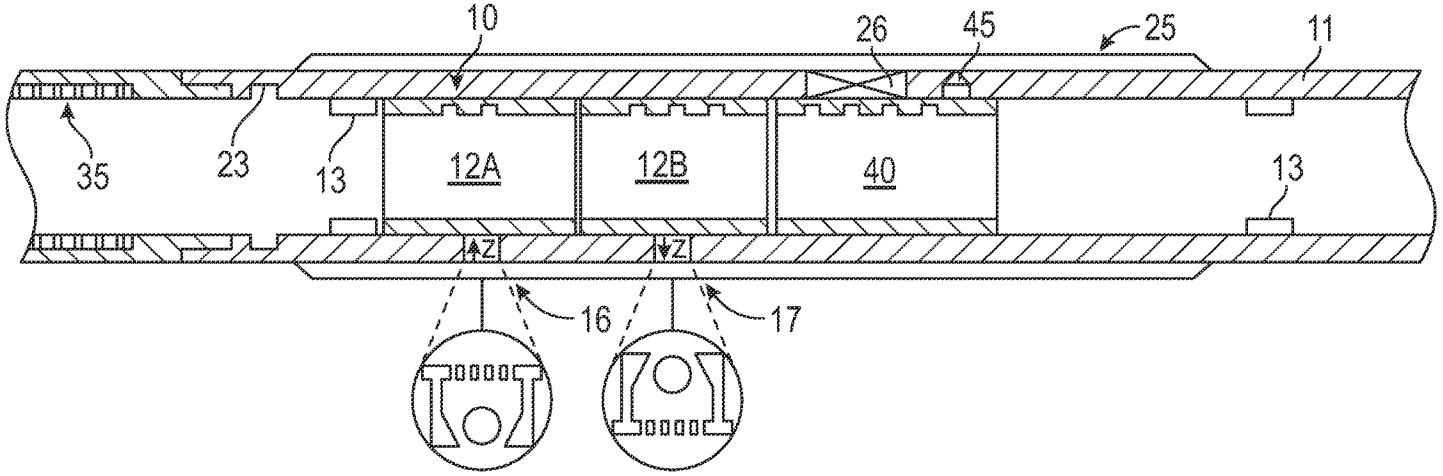
FIG. 3 illustrates an embodiment of the selective bi-directional valve assembly incorporated into the same sub as the propellant assembly.

FIG. 2 also illustrates a burst disc 26. "Burst" or "rupture" discs are conventional non-reclosing pressure relief devices that are a type of sacrificial member because they have a one-time-use membrane which fails at a predetermined differential pressure. The membrane is usually made out of metal, but nearly any material (or different materials in layers) can be used to suit a particular application. In preferred embodiments, the burst disc will be selected to rupture at or below a peak pressure produced when the propellant is ignited. Although FIG. 2 illustrates a single burst disc, other embodiments could have a plurality of burst discs selected to fail at the same pressure, or alternatively, selected to fail at different pressures. A nonlimiting example of a suitable burst disc is the Fike CPD or PAD series conventional rupture disk having a 500-11,000 psi operating range. However, other embodiments which have higher operating ranges may be employed. A firing sleeve 40 (also sometimes referred to as a "burst disc cover sleeve") is shown covering burst disc 26 and firing mechanism 45 (FIG. 3). The firing sleeve 40 acts to protect the burst disc and firing mechanism from premature actuation or damage from cementing operations and the like. Certain embodiments of firing sleeve 40 will include a unique opening profile 41 for selective engagement by an opening tool, but other embodiment could have an opening profile similar to other sleeves seen in FIG. 2 (i.e., the opening tool would engage the firing sleeve profile by knowing the relative position of the firing sleeve to other sleeves).

To the left of (i.e., uphole of) selective bi-directional valve assembly 10, FIG. 2 shows a marker sub 38 which is a casing section incorporating the identifiable marker 35. In one embodiment, the identifiable marker (which may also be referred to as a "tag" or "station ID") has a code or identifier which can be read by a reader on the opening tool (or other tools inserted into the branch wellbore). In one preferred embodiment, marker 35 is formed of a series of rings or bands 36 having different characteristics and where the arrangement of the rings 36 form the unique code. The reader on the opening tool will identify marker 35 when it approaches or passes through marker 35. The details of this type of marker 45 and how it is detected by a reader are described in U.S. Application Ser. No. 61/970,775, which is incorporated by reference herein in its entirety.

The marker locations in the tubular string are typically associated with some type of string feature or wellbore feature. For example, FIG. 2 shows the marker positioned within a known distance from the selective bi-directional valve assembly 10. In FIG. 2, there is also an opening tool landing profile 23 a given distance from marker 35, intended to allow an opening tool to detect the marker and engages keys allowing the opening tool to land or lock into the position of the landing profile. In the illustrated embodiments, the opening tool "locates on" the identifiable marker when it detects the marker and takes some pre-programmed action based on detecting the selected marker. In FIG. 1B, the marker 35A is associated with zone 105A and the marker 35B is associated with the zone 105B. FIG. 2 also shows markers 35X and 35Y which identify the location of the branch wellbores 102A and 102B respectively. In one example, the well may be logged after the casing string 2 has been cemented into the wellbore in order to confirm the position of the individual markers and correlate back to open hole logs, cased hole logs, or MWD/LWD data. The illustrated embodiments suggest "passive" markers, i.e., markers which do not emit a signal. However, other embodiments could employ active markers.

FIG. 3 illustrates one modification of the embodiment seen in FIG. 2. In the FIG. 3 embodiment, a single casing sub 11 includes both the selective bi-directional valve assembly 10 and the propellant sleeve 25. The propellant sleeve 25 extends over the bi-directional valve assembly 10 and the firing sleeve 40 is adjacent to valve sleeves 12. As in FIG. 2, identifiable marker 35 is shown on a separate sub, but could obviously be incorporated on the same casing sub 11 as the bi-directional valve assembly 10 and propellant sleeve 25.

Figure 4:
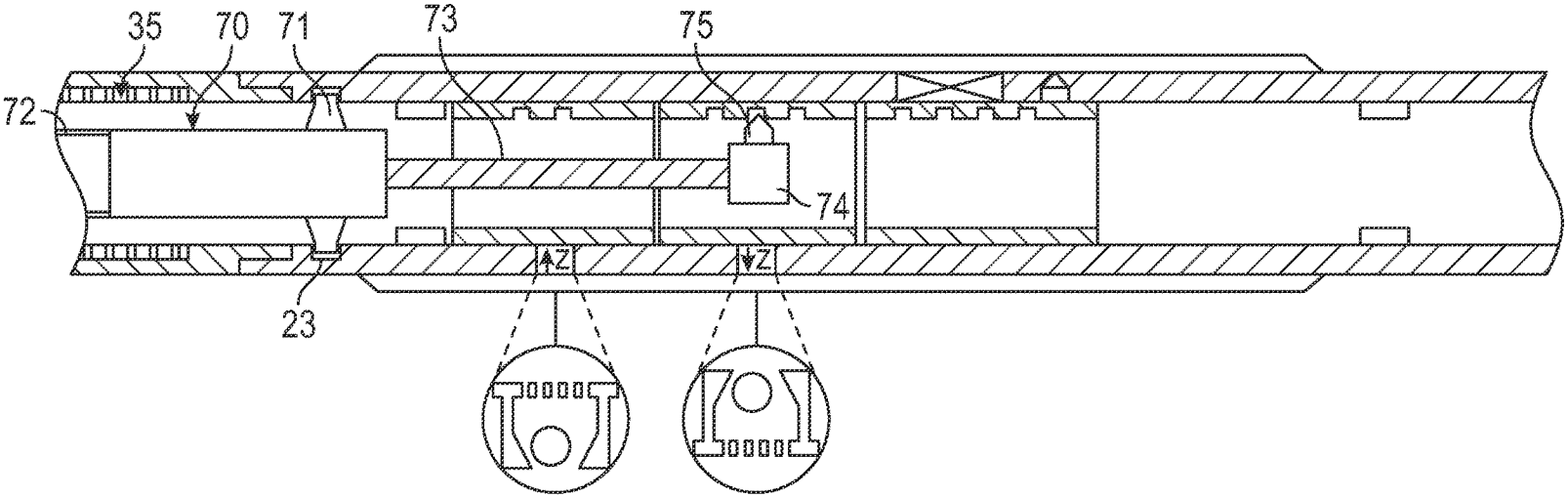
FIG. 4 illustrates one tool used to configure the selective bi-directional valve assembly.

FIG. 4 illustrates one example of an opening tool which could be utilized with the present invention. In FIG. 4, the opening tool 70 is attached to coil tubing 72 which extends to the surface. Thus, this embodiment of the opening tool may be considered "tethered" to the surface. Opening tool 70 will include deployable/retractable keys 71 designed to engage the landing profile 23. Opening tool 70 will include a reader and other electronics (not shown) which selectively detect the specific identifiable marker 35 associated with the particular bi-directional valve assembly. Upon detecting the desired identifiable marker 35, the keys 71 will deploy, engage landing profile 71, and secure the opening tool in the position suggested in FIG. 4. This embodiment of landing tool 70 will have an extendable threaded arm 73 with a key deploying head 74 position on the end of the arm 73. Because the distance between the landed opening tool and the various sleeves will be predetermined, the opening tool electronics and software will execute preprogrammed commands that extend arm 74 the correct distance to engage the desired key and shift the sleeves 12 or 40 to the desired configuration. At the correct location, the deploying head 74 will deploy keys 75 to engage the profile on the desired sleeve The foregoing example uses the known distance of a sleeve from the landing profile and therefore does not require the different sleeves to have unique profiles. In one preferred embodiment, the coil tubing could include a power conducting electrical line extending there-through from the surface. Power from this electrical line could be employed to operate the opening tool. Alternatively, the electrical systems of the opening tool could be powered by onboard batteries.

However, in an alternate embodiment where the sleeves have unique profiles and the deploying head can deploy different key sets, the distance from the landing profile to the sleeves is less important. In this latter embodiment, the deploying head 74 can simply initially deploy the desired key set and let the keys drag across all sleeve profiles until it encounters the matching profile. The electronics and software may keep a log of all actions so the actions may be reviewed at surface (after the tool is withdrawn from the well bore) in order to assure the proper configuration was achieved.

Figure 5:
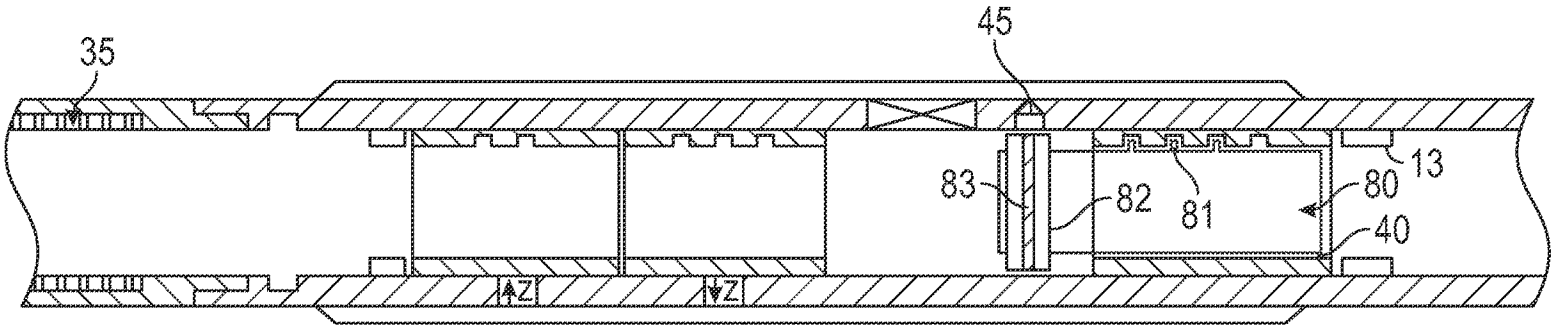
FIG. 5 illustrates a "smart plug" used to shift the firing sleeve and provide power to the firing mechanism inside the propellant chamber.

FIG. 5 illustrates another embodiment of an opening tool, electronically enabled (or "smart") plug 80. Plug 80 will include the marker reader described above and the electromechanical components required to detect a station ID and selectively deploy keys 81 and carry out the other functions described herein. Smart plug 80 will be pumped down toward the desired location in the completion string 2. In this sense, smart plug 80 may be considered an example of an untethered opening tool. Although not shown in FIG. 1B, it will be understood that casing string of similar diameter as completion string 2 will be run in and stabbed into the sealbore packer 65 via any conventional technique, thus providing the path for delivery of the smart plugs 80 into the branch wellbore(s).

As smart plug 80 approaches the set of sleeves it is intended (e.g., preprogrammed) to engage, the reader will detect the associated marker 35 and deploy the appropriate keys 81 to engage the profile on the sleeve of interest (i.e., in this embodiment, each sleeve has a unique profile). In addition to keys 81, plug 80 will include the deployable sealing element 82. Upon keys 81 engaging sleeve 40 (in the example of FIG. 5), additional fluid pressure within casing 2 will advance sleeve 40 until it encounters sleeve stops 13. Thereafter, smart plug 80 causes sealing element 82 to expand and engage the inner diameter of the casing, thereby sealing off the casing below smart plug 80. This embodiment of smart plug 80 also include the conductive strip 83 positioned on sealing element 82. Smart plug 80 and the location of the electrical firing mechanism 45 are configured such that when smart plug 80 has pushed sleeve 40 against the stops 13 and expanded the sealing element, then the conductive strip 83 can come into electrical contact with firing mechanism 45. Thus, onboard batteries in smart plug 80 may transfer electrical firing codes to firing mechanism 45 and the electrical power needed for firing mechanism 45 to activate the propellant. After the propellant has been activated and other possible completion steps undertaken, it will often be desirable to remove smart plug 80 from the passageway. In one embodiment, smart plug 80 is capable of retracting keys 81 and sealing element 82 such that the plug may be pumped or pushed via coiled tubing to the toe of the well where it will not interfere with operations. In another embodiment, smart plug 80 may be formed of a drillable material such as a carbon fiber composite and may be drilled-out by a conventional drilling tool deployed on coil tubing for that task. In other embodiments, smart plug 80 could be formed of a dissolvable material that is exposed to an acid or solvent (or includes an encapsulated breaker inside the smart plug 80) in order to break the material chains and weaken the plug structure to the point that it can flow out of the casing.

Figure 6A:
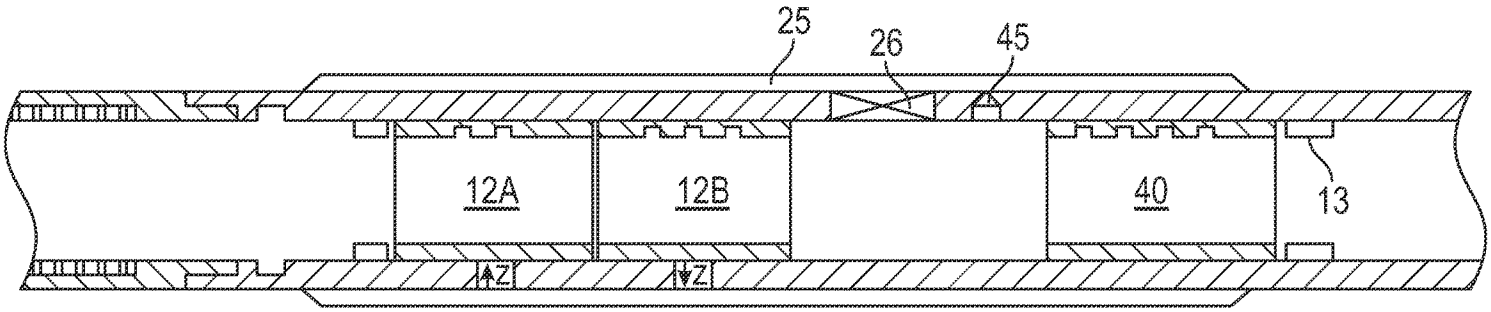
FIGS. 6A to 6C illustrate a sequence of sleeve operations within the bi-directional valve assembly.
Figure 6B:
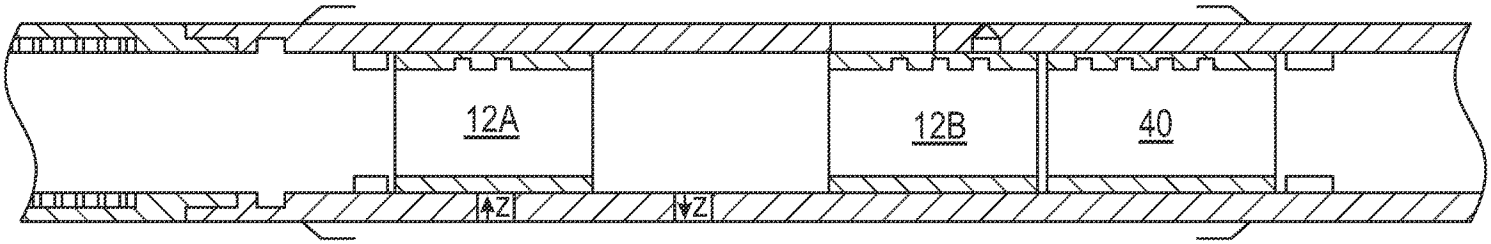
Figure 6C:
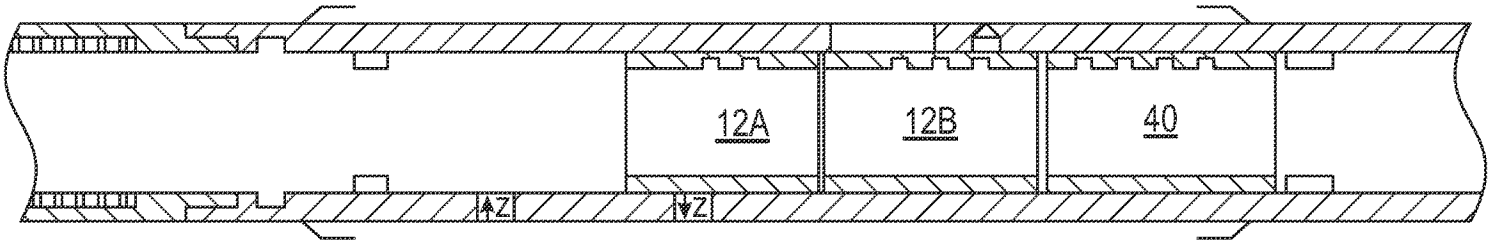

FIGS. 6A to 6C illustrate one example of the opening sequence of sleeves in order to carry out a particular function or method. In FIG. 6A, sleeve 40 has been moved to uncover firing mechanism 45 and burst disc 26. In one preferred method, a smart plug 80 (as in FIG. 5) will be used to engage the firing sleeves 40 while the coil tubing conveyed opening tool is used at a later time to engage the sleeves 12. In a manner described above (or any other manner), firing mechanism 45 will be triggered and the propellant ignited, causing the rupture of burst disc 26. Many well completion or production processes may require the pumping of high pressure fluid into the formation through a comparatively large and robust aperture. The opening left by ruptured burst disc 26 serves this purpose well. For example, hydraulic fracturing, acid treatment, or other well stimulation techniques may be performed through this opening in order to prepare the formation for production. However, the opening left by ruptured burst disc obviously allows two-way flow. At some point, it may become desirable to reconfigure this zone in the well such that only discharge-only valve 17 is open (uncovered). Thus, in FIG. 6B, sleeve 12B is engaged with an opening tool (not shown) and moved downhole until it engages sleeve 40. As discussed above, one preferred method employs the tethered opening tool for this operation. At this stage, sleeve 12B has uncovered discharge-only valve 17, but covered the opening of ruptured burst disc 26. Thus, fluid pumped into casing 2 may flow out of discharge-only valve 17, but no fluid from outside the casing can flow in at this zone of casing 2.

As suggested in FIG. 6C, sleeve 12A could also be shifted to the right until it encounters sleeve 12B. In this configuration, discharge-only sleeve 17 is now covered (closed) and intake-only valve 16 has been opened. This will allow fluid from the formation to enter the casing at this zone, but does not allow fluid within the casing to flow into the formation.

One method of the present invention may be understood by referring back to FIG. 1B. After the completion string as described above has been located within the branch wellbore 102A, the cementing process will include injecting cement into casing 2 and then following the cement with a cement plug. The cement plug will travel down casing 2, forcing the cement out of the end of the casing and back up the annulus between the casing and the wellbore, as is well known in the art. In one preferred method, the cement plug will have a set of keys that may engage the firing sleeve 40 in the lowest zone of the branch wellbore (i.e., the sleeve associated with propellant sleeve 25B in FIG. 1B) and slide that sleeve in order to expose the firing mechanism, which in this example is a pressure activated firing mechanism. The cement is then allowed to set or cure completely. At this time, the cured cement acts to isolate the interior of the casing from the formation outside the casing. In other words, fluid pumped into the casing cannot escape into the formation. However, pressuring up on the fluid within the casing will act to trigger the pressure activated firing mechanism associated with propellant sleeve 25B. The force generated from the ignited propellant will be sufficient to breakup and substantially pulverize the cement over and adjacent to the propellant sleeve (including the cement over any adjacent bi-directional valve assembly such as seen in FIG. 2). With the burst disc associated with propellant sleeve 25B now ruptured from the propellant activation and allowing fluid communication with the reservoir, additional steps may be taken using fluid pumped through the casing string 2. For example, other smart plugs 80 may be pumped into the casing string with the smart plug programmed to land at the identifiable marker associated with the propellant sleeve 25A. There, the smart plug 80 could perform the actions described above to ignite the propellant in the propellant sleeve 25A. As referenced above, FIG. 1B shows two zones of propellant sleeves 25 for simplification and there could typically be many addition zones with branch wellbore 102A. Thus, the process for delivering a smart plug 80 to the propellant sleeve in a particular zone and igniting the propellant therein could be repeated for as many zones as required. Additionally, if branch wellbore 102B were to have a similar casing string 2 cemented therein, the above process could be repeated for branch wellbore 102B and any other branch wellbores having the casing string with bi-directional valves and propellant sleeves.

Once the propellant sleeves have been ignited and the surrounding cement layer is broken-up/pulverized, the selective bi-directional valve assemblies will be configured through the steps described above. For example, the opening tool on coiled tubing could be run into the branch wellbore and begin selectively configuring the bi-directional valve assemblies. In one embodiment, the bi-directional valve assembly 10 in one zone in the branch wellbore could be set in the discharge-only configuration while one or more bi-directional valve assemblies in other zones could be set to the intake-only configuration. The particular configuration of the different bi-directional valve assemblies will vary depending on many factors such the location of compartments within the formation, the orientation of the lateral wellbores through the formation, the relative number and position of vertical wellbores, and the sections or compartments of the formation being subject to water flooding.

Again, this procedure could be repeated in any other branch wellbores having bi-directional valve assemblies. After all the bi-directional valve assemblies are configured as desired, water (or another fluid or even potentially a gas such as $CO_2$) would be pumped into the various branch wellbores and/or selected vertical wellbores and placed under a given positive pressure (i.e., a pressure above the hydrostatic pressure of the flooded branch wellbore). As one example, this positive pressure might be in the range of 100 psi to 2500 psi, but this could vary greatly depending on individual formation characteristics. This positive pressure could be applied for days or weeks (or possibly even longer time periods). For those bi-directional valve assemblies configured for discharge only, the pressurized water may exit the casing and permeate into that zone/compartment. However, the water obviously does not exit the casing and permeate the zones where the bi-directional valves have been set to the intake-only configuration. As the water permeates into and pressurizes the selected zone/compartment, it will tend to raise the pressure of the selected zone/compartment. This will tend to direct petroleum toward an unpressurized vertical wellbore or possibly an open intake-only valve in the same compartment. Although the intake-only valves may be open in these adjacent zones/compartments during the flooding step, the positive pressure water in the casing string typically will prevent in any hydrocarbons from entering through these open valves. Once the intended duration of the water flooding step is complete, the water will be pumped from the wellbore. Now at this point, hydrocarbons may enter the casing through the intake-only valves or appropriate vertical wellbores and is removed to the surface in any conventional manner.

It will be apparent that the above describe processes are merely examples and enumerable variations are within the scope of the present invention. For instance, the above procedure describes first igniting the propellant sleeves in multiple zones and thereafter configuring the selective bi-directional valve assemblies in each zone. However, an alternative method would be igniting the propellant sleeve in one zone (e.g., the lowermost) and then configuring the selective bi-directional valve assembly in that zone. Thereafter, the propellant sleeve in the next highest zone would be ignited and the selective bi-directional valve assembly in that zone configured, with this sequence being repeated for as many zones as desired. Likewise, while one preferred method utilizes the tethered opening tool to configure sleeves 12, other methods could use smart plugs to configure sleeves 12 (i.e., as well as opening the firing sleeves 40). All such variations and modifications are intended to come within the scope of the following claims.

The invention claimed is:

1. A method of managing a hydrocarbon producing formation having a primary wellbore including at least one deviated branch wellbore, the method comprising the steps of:

a. positioning a production casing string in the deviated branch wellbore, the production casing string including:

i. a plurality of propellant sleeves positioned on the exterior of the production string, wherein a propellant in the propellant sleeves has a burn rate of between 300 ft/sec and 10,000 ft/sec;

ii. an identifiable marker associated with each propellant sleeve;

iii. at least one discharge-only valve and at least one intake-only valve associated with each propellant sleeve;

b. cementing the production casing string within the deviated branch wellbore;

c. positioning a tool within the production casing string where the tool locates on the identifiable marker associated with one of the propellant sleeves;

d. selectively igniting propellant in the propellant sleeve of step (c); and e. opening at least one of the discharge-only valve or intake-only valve associated with the propellant sleeve in step (c).

2. The method of claim 1, wherein separate valve sleeves cover each of the intake-only and discharge-only valves.

3. The method of claim 2, wherein a tool is used to open the discharge-only valve or the intake-only valve.

4. The method of claim 3, wherein the tool locks into a profile on the string when the tool locates on the identifiable marker.

5. The method of claim 3, wherein the tool has an extension arm which engages one or more of the valve sleeves covering the intake-only and discharge-only valves.

6. The method of claim 3, wherein the tool is tethered to the surface.

7. The method of claim 3, wherein the tool is untethered.

8. The method of claim 1, wherein the propellant sleeves are each associated with a firing mechanism selectively covered by a firing sleeve.

9. The method of claim 8, wherein at least one burst disc is positioned between each propellant sleeve and each firing sleeve.

10. The method of claim 1, wherein the discharge-only and intake-only valves are formed in a first casing sub and the propellant sleeves are positioned on a second casing sub.

11. The method of claim 1, wherein the discharge-only and intake-only valves and the propellant sleeves are formed on the same casing sub.

12. The method of claim 1, wherein the propellant in each of the propellant sleeves is first ignited and thereafter the intake-only or discharge-only valves associated with multiple propellant sleeves are opened.

13. The method of claim 1, further comprising the steps of (i) igniting propellant in a first propellant sleeve and opening at least one intake-only or discharge-only valve; and (ii) thereafter, igniting propellant in a second propellant sleeve and opening at least one other intake-only or discharge-only valve.

14. The method of claim 1, wherein the identifiable marker comprises a series of rings having different characteristics positioned on the casing in a specific arrangement, thereby forming a unique code based upon the arrangement of the rings.

15. A method of secondary recovery in a petroleum field having at least one petroleum producing formation and a plurality of vertical wellbores, the method comprising the steps of:

a. from at least one of the vertical wellbores, forming at least one deviated branch wellbore;

b. placing a production string in the deviated branch wellbore, the production string comprising a plurality of zones with each zone including:

i. at least one propellant sleeve positioned on an exterior of the production string, the at least one propellant sleeve including: (1) a propellant having a burn rate of between about 300 ft/sec and about 10,000 ft/sec, (2) a firing mechanism, and (3) a firing sleeve for selectively covering uncovering the firing mechanism;

ii. at least one identifiable marker associated with the zone; and iii. a selective bi-directional valve assembly associated with the zone;

c. configuring the bi-directional valve assemblies to enhance secondary recovery based upon injection of a liquid or a gas into either or both of (i) at least one of the bi-directional valve assemblies, or (ii) at least one of the vertical wellbores; and d. moving a valve sleeve to uncover an intake-only valve associated with at least one other propellant sleeve positioned in the deviated branch wellbore.

16. The method of claim 15, wherein the bi-directional valve assemblies include at least one intake-only valve and at least one discharge only valve.

17. The method of claim 15, wherein a firing mechanism on the lowermost propellant sleeve is pressure activated and the firing sleeve is moved to uncover the firing mechanism by a cement plug employed during the cementing step.

18. The method of claim 17, further comprising the step of introducing a treating fluid under pressure into the formation through the open discharge-only valve during a first period of time.

19. A method of managing a hydrocarbon producing formation having a primary wellbore including at least one deviated branch wellbore, the method comprising the steps of:

a. positioning a production casing string in the deviated branch wellbore, the production casing string including:

i. a propellant sleeve positioned on the exterior of the production string, wherein a propellant in the propellant sleeves has a burn rate of between 300 ft/sec and 10,000 ft/sec;

ii. a burst disc position on the production string and configure to create a passage through the production string upon rupture;

iii. at least one discharge-only valve and at least one intake-only valve associated with the production string;

iv. at least one sleeve configured to be shiftable from covering at least one of the discharge-only valve or intake-only valve to covering the burst disc passage;

b. igniting propellant in the propellant sleeve, thereby rupturing the burst disc and opening the passage through the production string;

c. pumping a liquid or a gas through the burst disc passage at a first flow rate for a first time period; and d. after the first time period, shifting the sleeve to cover the burst disc passage and uncover at least one of the discharge-only valve or intake-only valve, thereby allowing flow out of or into the production string at a second flow rate, lesser than the first flow rate.

* * * * *